US005799750A

United States Patent [19]

Garcia

[11] Patent Number: 5,799,750

[45] Date of Patent: Sep. 1, 1998

[54] PORTABLE SCAFFOLD

[76] Inventor: Guadalupe Garcia, 2457 W. Hatch Rd., Molsto, Calif. 95351

[21] Appl. No.: 775,155

[22] Filed: Dec. 31, 1996

[51] Int. Cl.[6] ..... E04G 3/00

[52] U.S. Cl. ..... 182/82; 182/113; 182/222; 182/223

[58] Field of Search ..... 182/82, 87, 113, 182/187, 188, 222, 223

[56] References Cited

U.S. PATENT DOCUMENTS

| | | | |
|---|---|---|---|
| 2,805,902 | 9/1957 | Von Drasek et al. | 182/82 |
| 3,134,567 | 5/1964 | Shoemaker | 182/82 X |
| 4,153,229 | 5/1979 | Bequette | 182/82 X |
| 4,534,446 | 8/1985 | Pujol-Barcons | 182/82 X |
| 4,979,725 | 12/1990 | Hutchings, II et al. | 182/82 X |
| 5,259,477 | 11/1993 | Fears et al. | 182/82 |
| 5,314,167 | 5/1994 | Holloman | 182/113 X |
| 5,388,663 | 2/1995 | Phillippe et al. | 182/82 |
| 5,441,125 | 8/1995 | Cook | 182/82 |
| 5,503,358 | 4/1996 | Lapp | 182/82 X |
| 5,524,727 | 6/1996 | Yennie, Jr. | 182/82 |

*Primary Examiner*—Alvin C. Chin-Shue
*Assistant Examiner*—Richard M. Smith

[57] ABSTRACT

A portable scaffold adapted to be utilized with a building having a vertical wall. Also included is a plurality of supports each with a generally L-shaped configuration. Each support comprises a first vertically oriented elongated side with a plurality of linearly aligned mounting holes formed therein for allowing removable coupling with a plurality of linearly aligned mounting pegs situated on the wall. A second horizontally oriented side is integrally coupled at an inboard end thereof to an upper end of the first side of the support. In use, the second sides of the supports are situated at an equivalent height. Finally, a plurality of elongated planks are adapted to be removably positioned lengthwise across the second side of each support for supporting weight thereon.

1 Claim, 3 Drawing Sheets

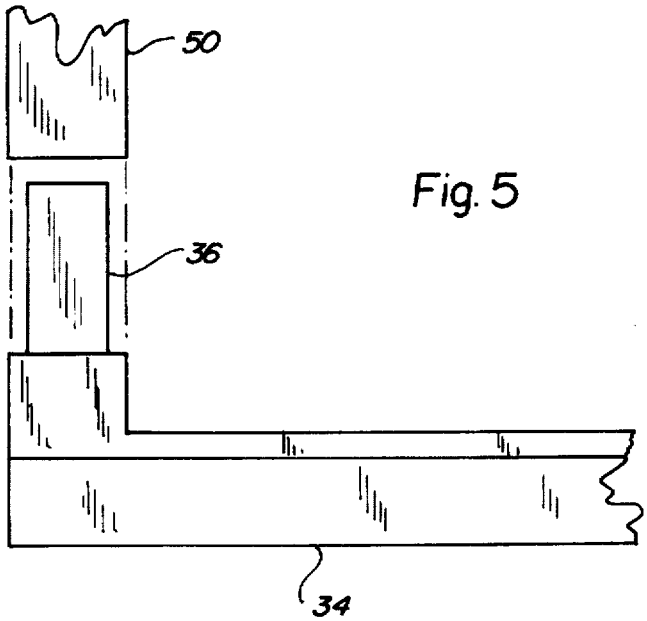
Fig. 5
Fig. 6
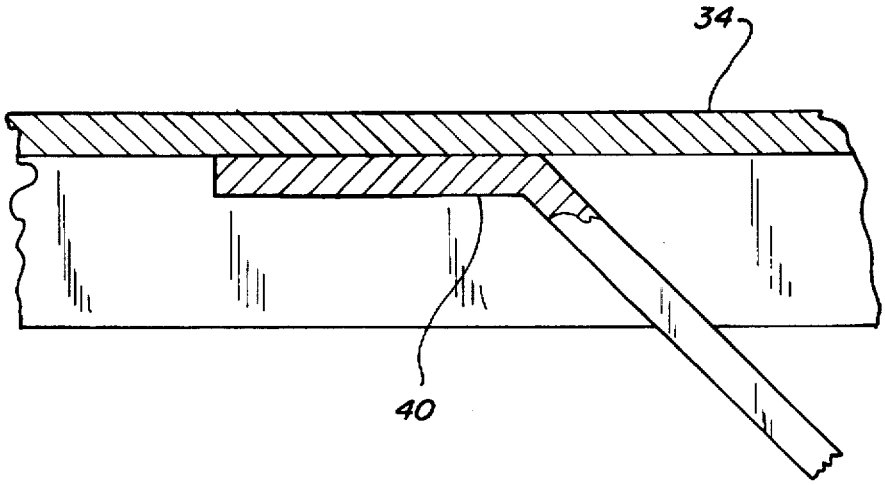

PORTABLE SCAFFOLD

BACKGROUND OF THE INVENTION

1. Field of the Invention

The present invention relates to a portable scaffold and more particularly pertains to providing a safe, versatile scaffold which is easily installed and removed.

2. Description of the Prior Art

The use of scaffolds is known in the prior art. More specifically, scaffolds heretofore devised and utilized for the purpose of scaffolding a vertical wall are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,510,097 to McCaleb a metal scaffolding mountable on a building wall via support members with a depending hook member associated therewith. U.S. Pat. No. 4,021,011 to Karlsson et al. discloses a device for the attachment of a scaffolding bracket to a vertical wall surface for use with the ship building industry. U.S. Pat. No. 4,453,619 to Bierman discloses a telescoping wall scaffold for providing simple vertical adjustment thereof. U.S. Pat. No. 4,850,453 to St-Germain and U.S. Pat. No. 4,738,335 to Ishii are provided as being of general interest.

In this respect, the portable scaffold according to the present invention substantially departs from the conventional concepts and designs of the prior art, and in so doing provides an apparatus primarily developed for the purpose of providing a safe, versatile scaffold which is easily installed and removed.

Therefore, it can be appreciated that there exists a continuing need for a new and improved portable scaffold which can be used for providing a safe, versatile scaffold which is easily installed and removed. In this regard, the present invention substantially fulfills this need.

SUMMARY OF THE INVENTION

In view of the foregoing disadvantages inherent in the known types of scaffolds now present in the prior art, the present invention provides an improved portable scaffold. As such, the general purpose of the present invention, which will be described subsequently in greater detail, is to provide a new and improved portable scaffold which has all the advantages of the prior art and none of the disadvantages.

To attain this, the present invention essentially comprises a building with a vertical wall having a garage door opening situated at a lower extent thereof. The garage door opening has a top edge, a bottom edge, and a pair of side edges. Also included is a pair of primary angle iron supports with a generally L-shaped configuration. Each primary support comprises a first vertically oriented elongated side with a plurality of linearly aligned mounting holes formed therein. The mounting holes are included for allowing removable coupling with a plurality of linearly aligned mounting pegs situated adjacent to the side edges of the garage door opening. Each mounting hole has a circular aperture with an oval notch extending upward therefrom. Each mounting peg comprises a nail with a first annular flange situated at an end thereof and a second annular flange situated adjacent to the first annular flange with a space situated therebetween. The space is approximately ¼ inch and is adapted to receive the notch of the mounting hole. Each of the primary supports comprises a second horizontally oriented side integrally coupled at an inboard end thereof to an upper end of the first side. The second side has a short rectangular post formed in an outboard end thereof which extends upwards therefrom. For strengthening purposes, a strut is included with an upper end connected to the second side of the support and a lower end connected to the first side of the support at a lower extent thereof. Ideally, the strut forms a 45-degree angle with both the first and second side of the support. Also, the second sides of each support are situated so that the top surfaces thereof reside at an equivalent height. For allowing the scaffold to be utilized over garage doors, entry ways, and the like, a secondary angle iron support with a structure similar to that of the primary supports is included. The secondary support has a first side with a length half of that of the primary supports. The first side is adapted to be connected adjacent to the top edge of the garage door opening at a central extent thereof. As best shown in FIG. 3, a sway brace is pivotally coupled at a first end thereof to a central extent of the second horizontally oriented side of each primary angle iron support. The sway brace is adapted to pivot in a horizontal plane. In use, the second ends of the sway braces are adapted to be coupled to the wall in order to afford lateral stability. Also included is a plurality of retention cables. Working in conjunction with such cables are a plurality of uprights each comprising of a hollow rectangular rod. Each upright is adapted to releasably receive one of the posts of the supports. A plurality of cable coupling mechanisms are situated on each of the uprights for removably coupling the retention cables thereto at a fixed distance from the outboard end of the supports. In an operative orientation, the retention cables extend between the uprights. Finally, a plurality of elongated planks are adapted to be removably positioned lengthwise across the second side of each support for supporting weight thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable scaffold which has all the advantages of the prior art scaffolds and none of the disadvantages.

It is another object of the present invention to provide a new and improved portable scaffold which may be easily and efficiently manufactured and marketed.

It is a further object of the present invention to provide a new and improved portable scaffold which is of a durable and reliable construction.

An even further object of the present invention is to provide a new and improved portable scaffold which is susceptible of a low cost of manufacture with regard to both materials and labor, and which accordingly is then susceptible of low prices of sale to the consuming public, thereby making such portable scaffold economically available to the buying public.

Still yet another object of the present invention is to provide a new and improved portable scaffold which provides in the apparatuses and methods of the prior art some of the advantages thereof, while simultaneously overcoming some of the disadvantages normally associated therewith.

Still another object of the present invention is to provide a safe, versatile scaffold which is easily installed and removed.

Lastly, it is an object of the present invention to provide a new and improved portable scaffold adapted to be utilized with a building having a vertical wall. Also included is a plurality of supports each with a generally L-shaped configuration. Each support comprises a first vertically oriented elongated side with a plurality of linearly aligned mounting holes formed therein for allowing removable coupling with a plurality of linearly aligned mounting pegs situated on the wall. A second horizontally oriented side is integrally coupled at an inboard end thereof to an upper end of the first side of the support. In use, the second sides of the supports are situated at an equivalent height. Finally, a plurality of elongated planks are adapted to be removably positioned lengthwise across the second side of each support for supporting weight thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded view of the post and associated upright.

FIG. 6 is a cross-sectional view taken along line 6—6 shown n FIG. 3.

Similar reference characters refer to similar parts throughout the several views of the drawings.

DESCRIPTION OF THE PREFERRED EMBODIMENT

Figure 1:
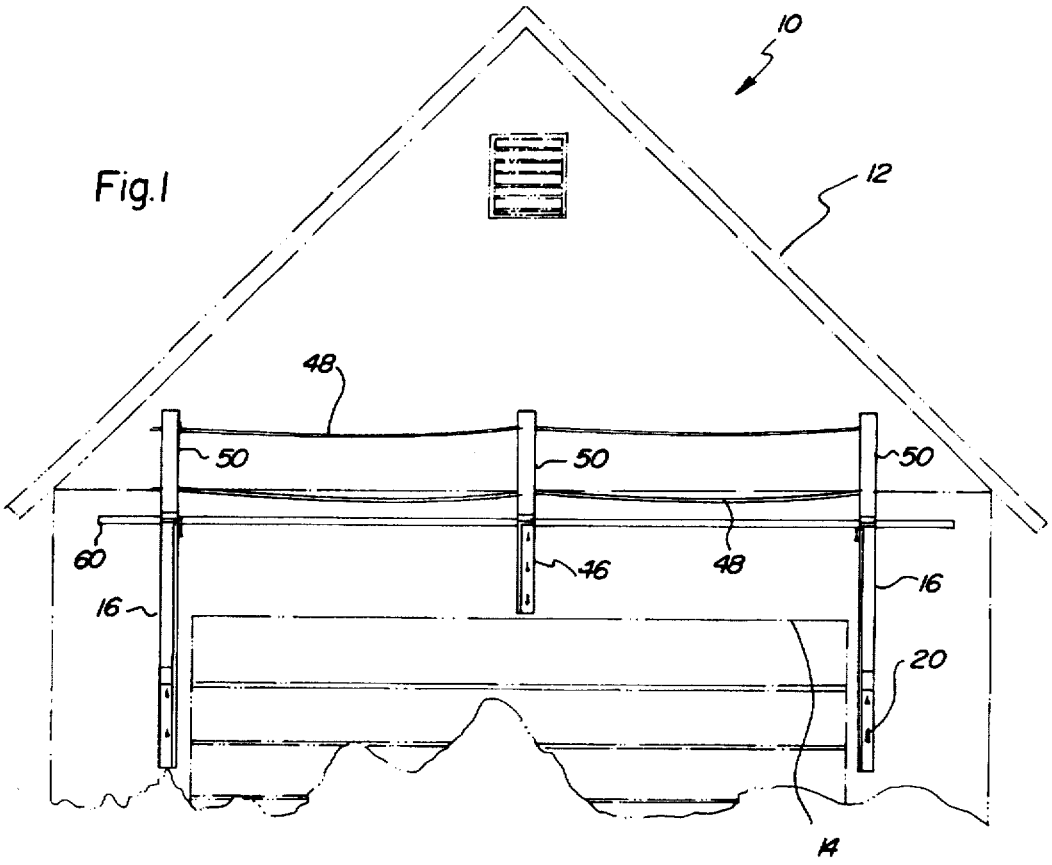
FIG. 1 is an illustration of the preferred embodiment of the portable scaffold constructed in accordance with the principles of the present invention.
Figure 2:
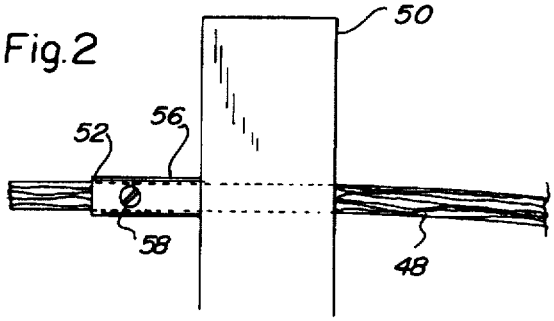
FIG. 2 is a front elevational view of the coupling mechanism employed by the present invention.

With reference now to the drawings, and in particular to FIG. 1 thereof, a new and improved portable scaffold embodying the principles and concepts of the present invention and generally designated by the reference numeral 10 will be described.

The present invention, the new and improved portable scaffold, is comprised of a plurality of components. Such components in their broadest context include a building, primary angle irons, secondary angle iron, retention cables, uprights, and planks. Such components are individually configured and correlated with respect to each other so as to attain the desired objective.

More specifically, it will be noted that the system 10 of the present invention includes a building 12 with a vertical wall having a garage door opening 14 situated at a lower extent thereof. The garage door opening has a top edge, a bottom edge, and a pair of side edges.

Also included is a pair of primary angle iron supports 16 with a generally L-shaped configuration. Ideally, each side extent of the angle iron structure has a length of approximately 1 and ½ inches and is constructed of a durable steel with a thickness of approximately ¼ inch. Each primary support comprises a first vertically oriented elongated side 18 with a plurality of linearly aligned mounting holes 20 formed therein. The first side of the support has a length of approximately 26 inches. The mounting holes are included for allowing removable coupling with a plurality of linearly aligned mounting pegs 22 situated adjacent to the side edges of the garage door opening. Each mounting hole 20 has a circular aperture 26 with an oval notch 28 extending upward therefrom. Each mounting peg 22 comprises a nail with a first annular flange 30 situated at an end thereof and a second annular flange 32 situated adjacent to the first annular flange with a space situated therebetween. The space is approximately ¼ inch and is adapted to receive the notch of the mounting hole. Each of the primary supports comprises a second horizontally oriented side 34 integrally coupled at an inboard end thereof to an upper end of the first side. Preferably, the second side of the support has a length of approximately 26 inches. The second side has a short rectangular post 36 formed in an outboard end thereof which extends upwards therefrom. For strengthening purposes, a strut 38 is included with an upper end 40 connected to the second side of the support and a lower end 42 connected to the first side of the support at a lower extent thereof. Ideally, the strut forms a 45-degree angle with both the first and second side. Optionally, the struts may be hingably coupled to the first side of the support to effect easy storage. Also, the second sides of each support are situated so that the top surfaces thereof reside at an equivalent height.

For allowing the scaffold to be utilized over garage doors, entry ways, windows, and the like, a secondary angle iron support 46 with a structure similar to that of the primary supports is included. The secondary support has a first side with a length half of that of the primary supports. The first side is adapted to be connected adjacent to the top edge of the garage door opening at a central extent thereof.

Figure 3:
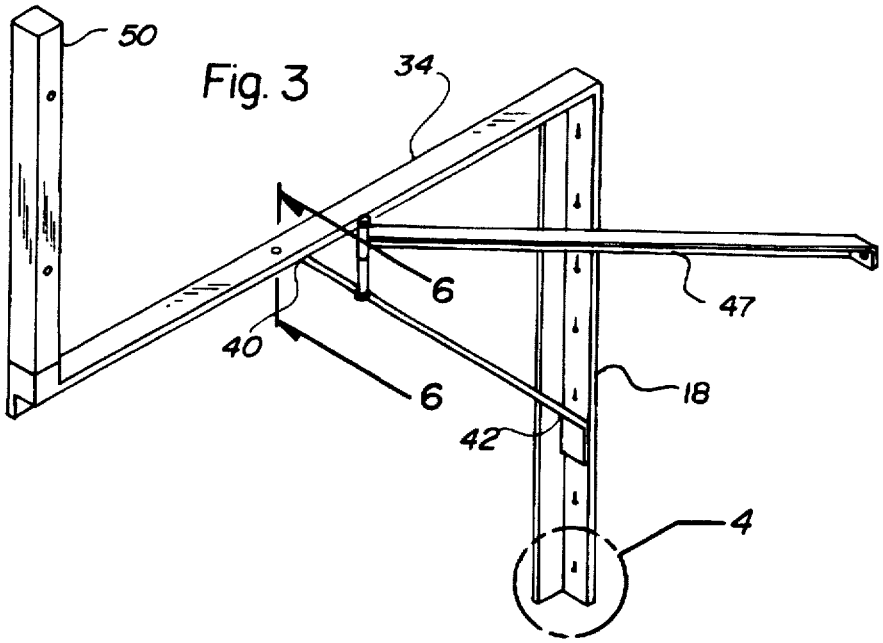
FIG. 3 is a perspective view of the primary angle iron support.
Figure 4:
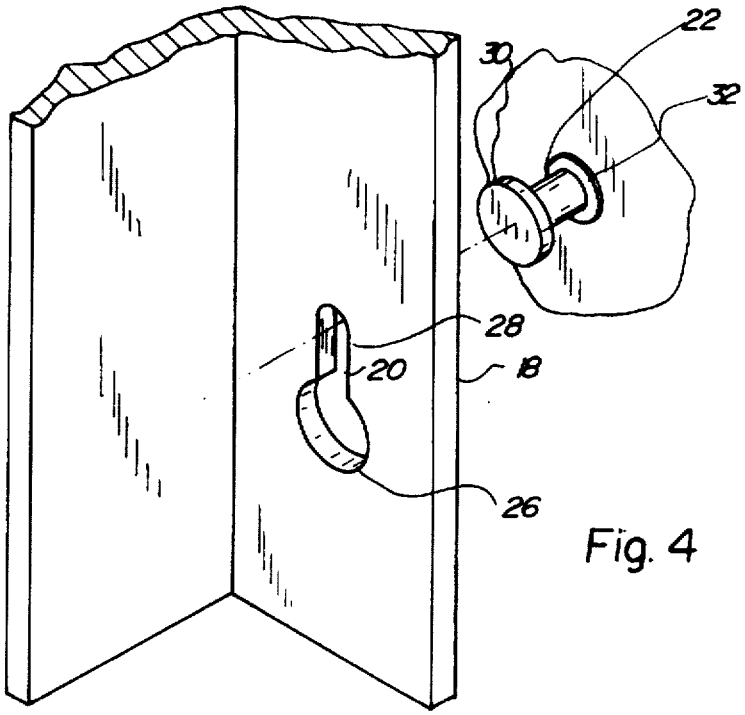
FIG. 4 is an exploded view of the area encircled in FIG. 3.

As best shown in FIG. 3, a sway brace 47 is pivotally coupled at a first end thereof to a central extent of the second horizontally oriented side of each primary angle iron support. Such coupling is preferably afforded via a small post coupled between the horizontally oriented side of the primary angle iron support and the strut. As such, the sway brace is adapted to pivot about the post in a horizontal plane. In use, the second ends of the sway braces are adapted to be coupled to the wall in order to afford lateral stability. Preferably, the sway brace defines a 45 degree angle with the wall when utilized.

Also included is a plurality of retention cables 48. Working in conjunction with such cables are a plurality of uprights 50 each comprising a hollow rectangular rod. Each upright is adapted to releasably receive one of the posts of the supports. A plurality of cable coupling mechanisms 52 are situated on each of the uprights for removably coupling the retention cables thereto at a fixed distance from the outboard end of the second side of the supports. Such cable coupling mechanisms consist of a tubular member 56 through which the cables may be inserted and a screw 58 for fixing the position of the cables with respect to the associated upright. In an operative orientation, the retention cables extend between the uprights.

Finally, a plurality of elongated planks 60 are adapted to be removably positioned lengthwise across the second side of each support for supporting weight thereon. The planks ideally include 2×12 sheets of wood.

The portable scaffold provides a safe convenient method of supporting weight in the form of person and/or supplies. The present invention may be employed to perform work such as installing shearwalls or simply to store miscellaneous items. The present invention is a versatile device that may be safely employed on any wall structure despite the presence of windows, doors, entryways, garages, or the like. When not in use, the portable scaffold may be easily disassembled and compactly stored away.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved portable scaffold comprising, in combination:

a building with a vertical wall having a garage door opening situated at a lower extent thereof, the garage door opening having a top edge, a bottom edge, and a pair of side edges;

a pair of primary angle iron supports with a generally L-shaped configuration each comprising a first vertically oriented elongated side with a plurality of linearly aligned mounting holes formed therein for allowing removable coupling with a plurality of linearly aligned mounting pegs situated adjacent to the side edges of the garage door opening with each mounting hole having a circular aperture with an oval notch extending upward therefrom and each mounting peg comprising a nail with a first annular flange situated at an end thereof and a second annular flange situated adjacent to the first annular flange with a space situated therebetween for receiving the notch of the mounting hole; a second horizontally oriented side integrally coupled at an inboard end thereof to an upper end of the first side, the second side having a short rectangular post formed in an outboard end thereof and extending upwards therefrom; and a strut with an upper end connected to the second side and a lower end connected to the first side at a lower extent thereof with the strut forming a 45-degree angle with the first side in at least one orientation; wherein the second sides of the supports are situated at an equivalent height;

a secondary angle iron support with a structure similar to that of the primary supports, the secondary support having a first side with a length half of that of the first side of the primary supports, the first side of the secondary support adapted to be connected adjacent to the top edge of the garage door opening at a central extent thereof;

a pair of sway braces each pivotally coupled at a first end thereof to a central extent of the second horizontally oriented side of each primary angle iron support and further adapted to pivot in a horizontal plane, wherein second ends of the sway braces are adapted to be coupled to the wall in use in order to afford lateral stability, wherein the sway brace is mounted to the wall and forms a 45 degree angle therewith;

a plurality of retention cables;

a plurality of uprights each comprising of a hollow rectangular rod, each upright adapted to releasably receive one of the posts of the supports, each upright comprising a cable coupling means for removably coupling the retention cables thereto at a fixed distance from the outboard end of the second side of the supports, wherein the retention cables extend between the uprights of the supports and the cable coupling means each includes a tubular member through which the cables may be inserted and a screw for fixing a position of the cables with respect to the associated upright; and a plurality of elongated planks adapted to be removably positioned lengthwise across the second side of each support for supporting weight thereon.

* * * * *